US009008335B2

(12) United States Patent
Choi et al.

(10) Patent No.: US 9,008,335 B2
(45) Date of Patent: Apr. 14, 2015

(54) DIRECTIONAL SOUND GENERATING APPARATUS AND DIRECTIONAL SPEAKER ARRAY INCLUDING THE SAME

(75) Inventors: Jung-woo Choi, Hwaseong-si (KR); Young-tae Kim, Seongnam-si (KR); Jung-ho Kim, Yongin-si (KR); Sang-chul Ko, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 770 days.

(21) Appl. No.: 12/554,951

(22) Filed: Sep. 7, 2009

(65) Prior Publication Data

US 2010/0061571 A1 Mar. 11, 2010

(30) Foreign Application Priority Data

Sep. 8, 2008 (KR) ..... 10-2008-0088277

(51) Int. Cl.

| | |
|---|---|
| ***H04R 25/00*** | (2006.01) |
| ***H04R 1/28*** | (2006.01) |
| ***H04R 1/34*** | (2006.01) |
| ***H04R 1/32*** | (2006.01) |
| *H04R 3/12* | (2006.01) |

(52) U.S. Cl.

CPC ..... *H04R 1/288* (2013.01); *H04R 1/345* (2013.01); *H04R 1/323* (2013.01); *H04R 3/12* (2013.01); *H04R 2201/403* (2013.01)

(58) Field of Classification Search

CPC ..... H04R 1/2819; H04R 1/02; H04R 1/2826; H04R 1/2857; H04R 1/288; H04R 1/345

USPC ..... 381/160, 335, 349, 352, 353, 345; 181/156, 199

See application file for complete search history.

(56) References Cited

U.S. PATENT DOCUMENTS

| | | | | |
|---|---|---|---|---|
| 2,858,889 | A * | 11/1958 | Lopez-Henriquez | 234/52 |
| 4,437,541 | A | 3/1984 | Cross | |
| 4,714,133 | A * | 12/1987 | Skaggs, Jr. | 181/160 |
| 5,659,155 | A * | 8/1997 | Porzilli | 181/0.5 |
| 6,643,379 | B1 * | 11/2003 | Onglao | 381/351 |
| 6,801,628 | B1 | 10/2004 | Thiel | |
| 6,870,942 | B1 * | 3/2005 | Graber | 381/349 |

(Continued)

FOREIGN PATENT DOCUMENTS

| | | |
|---|---|---|
| CN | 2324737 Y | 6/1999 |
| CN | 1992990 A | 7/2007 |

(Continued)

OTHER PUBLICATIONS

Masato, Miyoshi, "Inverse Filtering of Room Acoustics," IEEE Transactions on Acoustics, Speech and Signal Processing, vol. 36, No. 2, Feb. 1988, pp. 145-152.

(Continued)

*Primary Examiner* — Curtis Kuntz
*Assistant Examiner* — Ryan Robinson
(74) *Attorney, Agent, or Firm* — NSIP Law

(57) ABSTRACT

A directional sound generating apparatus and a directional speaker array including the same are disclosed. The directional sound generating apparatus includes a sound transducer, a reflection plate which is located behind the sound transducer, and a blocking plate which is provided between a front portion and a back portion of the sound transducer.

15 Claims, 9 Drawing Sheets

(56) References Cited

U.S. PATENT DOCUMENTS

| | | | | |
|---|---|---|---|---|
| 7,027,610 | B1 | 4/2006 | Kihara | |
| 7,513,332 | B2 * | 4/2009 | Moore | 181/155 |
| 7,711,135 | B2 * | 5/2010 | Tsutsumi | 381/345 |
| 8,031,895 | B2 * | 10/2011 | Schultz | 381/345 |
| 8,391,510 | B2 * | 3/2013 | Vincenot | 381/97 |
| 2004/0151325 | A1 | 8/2004 | Hooley et al. | |
| 2005/0178611 | A1 | 8/2005 | Noselli et al. | |
| 2005/0221867 | A1 | 10/2005 | Zurek et al. | |
| 2007/0030977 | A1 | 2/2007 | Konagai | |
| 2007/0144826 | A1 | 6/2007 | An et al. | |
| 2009/0136045 | A1 | 5/2009 | Kim et al. | |
| 2009/0147980 | A1 * | 6/2009 | Fincham | 381/352 |
| 2009/0154723 | A1 | 6/2009 | Choi et al. | |

FOREIGN PATENT DOCUMENTS

| | | | |
|---|---|---|---|
| JP | 46-002667 | | 9/1971 |
| JP | 59-69591 | | 5/1984 |
| JP | 06-105387 | | 4/1994 |
| JP | 09-70089 | A | 3/1997 |
| JP | 2008-005346 | | 1/2008 |
| KR | 1019910007844 | B1 | 10/1991 |
| KR | 1999-0039125 | | 11/1999 |
| KR | 20-0323424 | | 8/2003 |
| KR | 1020030089557 | | 11/2003 |
| KR | 1020090055203 | | 6/2009 |
| KR | 1020090066090 | | 6/2009 |

OTHER PUBLICATIONS

Sylvain Yon, et al., "Sound Focusing in Rooms: The Time-Reversal Approach," Accoustical Society of America, Nov. 2002, pp. 1533-1543.

L. E. Kinsler , et al., "Fundamentals of Acoustics," Fundamentals of acoustics, 4th edition, John Wiley & Sons, 2000. pp. 199-202.

Chinese Office Action issued Mar. 5, 2013 in counterpart Chinese Patent Application No. 200910170245.8 (7 pages, in Chinese).

European Search Report issued Apr. 2, 2014 in counterpart European Patent Application No. 09811740.01 (3 pages).

Japanese Office Action issued Jun. 18, 2013 in counterpart Japanese Patent Application No. JP2009-171828 ( 9 pages, including English Translation).

Japanese Office Action issued Feb. 3, 2015 in counterpart Application No. JP 2009-171828 (5 pages, in Japanese, with English language translation).

* cited by examiner

DIRECTIONAL SOUND GENERATING APPARATUS AND DIRECTIONAL SPEAKER ARRAY INCLUDING THE SAME

CROSS REFERENCE TO RELATED APPLICATION(S)

This application claims the benefit under 35 U.S.C. §119 (a) of Korean Patent Application No. 10-2008-0088277, filed on Sep. 8, 2008 in the Korean Intellectual Property Office, the disclosure of which is incorporated herein in its entirety by reference for all purposes.

BACKGROUND

1. Field

The following description relates to a directional sound generating technique, and more particularly, to a directional sound generating apparatus and a directional speaker array including the same.

2. Description of the Related Art

Typically, sound generating apparatuses such as loudspeakers output sound without directivity, and the output sound is radiated in all directions. Although sound pressures vary depending on the location of a listener, the sound spreads out widely from the sound generating apparatus. Therefore, those who do not want to hear the sound may inevitably be exposed to it. To avoid such noise pollution or disturbance, one may use headphones or earphones. However, these portable devices may be uncomfortable to wear or move with and may even impair the user's hearing.

Accordingly, technologies have been pursued to enable sound to be transmitted only to a particular listener or a particular area, i.e., a personal sound zone, without the use of additional devices such as earphones or headphones. For example, one technology employs a plurality of sound sources arranged in a line to output sound with different phases such that the directivity of the radiated sound is improved. Another technology employs a hard wall installed behind a sound source to improve sound directivity.

However, in such technologies, severe sound distortion may occur depending on the frequency range. Moreover, to achieve constant directivity over the whole frequency band, signal properties may require additional compensation according to frequency or the sound generating apparatus may need to be increased in size.

SUMMARY

According to one general aspect, there is provided a directional sound generating apparatus including a sound transducer, a reflection plate which is located behind the sound transducer, and a first blocking plate which is provided between a front portion and a back portion of the sound transducer.

The directional sound generating apparatus may further include a second blocking plate which is connected with the reflection plate and covers an area on top of the sound transducer and/or an area at bottom of the sound transducer.

The directional sound generating apparatus may further include a sound absorbing material provided to the reflection plate and/or the first blocking plate.

The sound absorbing material may absorb high-frequency components of a forward and backward sound waves and/or a backward sound wave output from the sound transducer.

The first blocking plate may extend substantially perpendicular to a traveling direction of a sound waves output from the sound transducer, and has a narrower width than the reflection plate.

A width of the second blocking plate may be equal to or less than a width of the reflection plate such that the second blocking plate completely or partly covers a space plan substantially perpendicular to the reflection plate and provided between the reflection plate and the sound transducer.

The first blocking plate may have a narrower width than the reflection plate.

The directional sound generating apparatus may further include one or more second blocking plates provided between the reflection plate and the first blocking plate so as to cover one or more respective sides of a space defined between the reflection plate and the first blocking plate.

The reflection plate, the first blocking plate, and the one or more second blocking plates may be formed as a single structure.

A length of a side of the one or more second blocking plates may be equal to or less than a length of a side of the reflection plate that is substantially parallel to the side of the one or more second blocking plates.

According to another general aspect, there is provided a directional speaker array including a plurality of directional sound generating units, at least one of which comprising a sound transducer, a reflection plate which is located behind the sound transducer, and a first blocking plate which is provided between a front portion and a back portion of the sound transducer.

Each of the plurality of directional sound generating units may include the sound transducer, the reflection plate and the first blocking plate, and the reflection plates may be formed as a single reflection plate shared by the plurality of directional sound generating units.

The at least one of the plurality of directional sound generating units may further include a second blocking plate which is connected with the reflection plate and formed to cover an area on top of the sound transducer and/or an area at bottom of the sound transducer.

The at least one of the plurality of directional sound generating units may further include a sound absorbing material provided to the reflection plate and/or the first blocking plate.

The sound absorbing material may absorb high-frequency components of the forward and backward sound waves and/or the backward sound wave output from the sound transducer.

The first blocking plate may extend substantially perpendicular to a traveling direction of the forward and backward sound waves output from the sound transducer and has a narrower width than the reflection plate.

The at least one of the plurality of directional sound generating units may further include one or more second blocking plates provided between the reflection plate and the first blocking plate so as to cover one or more respective sides of a space defined between the reflection plate and the first blocking plate.

A length of a side of the one or more second blocking plates may be equal to or less than a length of a side of the reflection plate that is substantially parallel to the side of the one or more second blocking plates Each of the plurality of directional sound generating units may include the sound transducer, the reflection plate, the first blocking plate, and the one or more second blocking plates, the reflection plates may be formed as a single reflection plate shared by the plurality of directional sound generating units, and the first blocking plates may be formed as a single first blocking plate shared by the plurality of directional sound generating units.

The shared reflection plate, the shared first blocking plate, and the one or more second blocking plates for each directional sound generating unit may be formed as a single structure, and the shared first blocking plate may include a slit provided between the directional sound generating units.

According to still another general aspect, there is provided a directional sound generating apparatus including a sound transducer, a reflection plate which is located behind the sound transducer, and one or more blocking plates provided between the reflection plate and the sound transducer so as to cover one or more respective sides of a space defined between the reflection plate and the sound transducer.

The directional sound generating apparatus may further include a baffle which is provided between a front portion and a back portion of the sound transducer, wherein the one or more blocking plates are provided between the reflection plate and the baffle so as to cover one or more respective sides of a space defined between the reflection plate and the baffle.

The one or more blocking plates may include a first blocking plate connected to a first end of the reflection plate and a first end of the baffle and a second blocking plate connected to a second end of the reflection plate and a second end of the baffle.

The one or more blocking plates may include a first blocking plate connected to a first end of the reflection plate and the sound transducer and a second blocking plate connected to a second end of the reflection plate and the sound transducer.

According to yet another general aspect, there is provided a directional speaker array including one or more sound transducers, a reflection plate which is located behind the sound transducers, a first blocking plate which is provided between a front portion and a back portion of the sound transducers, and one or more second blocking plates provided between the reflection plate and the first blocking plate so as to cover one or more respective sides of a space defined between the reflection plate and the first blocking plate, wherein the first blocking plate includes one or more openings provided between the sound transducers.

The reflection plate, the first blocking plate, and the one or more second blocking plates may be formed as a single structure.

Other features and aspects will be apparent from the following detailed description, the drawings, and the claims.

Figure 1:
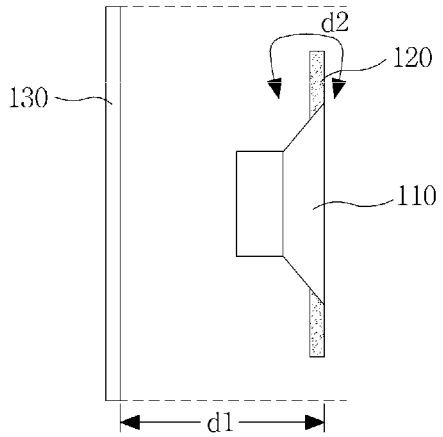
FIG. 1 is a diagram illustrating a side view of an exemplary directional sound generating apparatus.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

FIG. 1 shows an exemplary directional sound generating apparatus. Referring to FIG. 1, the directional sound generating apparatus includes a sound transducer 110 which generates sound, for example, a loudspeaker generating sound. The output sound from the sound transducer 110 is radiated forward and backward. That is, the sound transducer 110 outputs sound of opposite phase from its front and back.

The directional sound generating apparatus further includes a reflection plate 130 provided behind the sound transducer 110. The reflecting plate 130 blocks or reflects the sound radiated backward from the sound transducer 110.

The directional sound generating apparatus further includes a baffle 120, as a first blocking plate, which separates a front portion and a back portion of the sound transducer 110 to increase an interference distance d2 between the forward and backward sound waves. In other words, a sound pressure of the radiated sound varies according to, for example, a wavelength of the sound, a distance d1 between the sound transducer 110 and the reflection plate 130, and the interference distance d2 between the forward and backward sound waves output from the sound transducer 110. In an exemplary application, the distances d1 and d2 should be maintained constant but increased in a low frequency range where the wavelength of the sound is larger. Accordingly, where the sound transducer 110 is used open without the baffle 120 installed, the directional sound generating apparatus, that is, a directional speaker enclosure, should be increased in size to increase the distance d1. The baffle 120 facilitates destructive interference between the forward and backward sound waves, thereby increasing the virtual distance d2 the sound waves should travel for sound directivity. Accordingly, high radiation efficiency may be obtained in a low frequency range.

Figure 2:
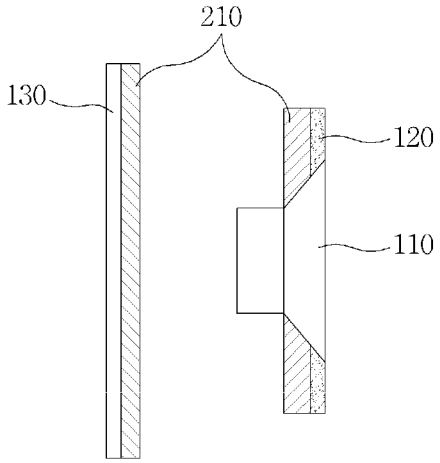
FIG. 2 is a diagram illustrating a side view of the directional sound generating apparatus of FIG. 1 which further includes a sound absorbing material.

FIG. 2 shows the directional sound generating apparatus of FIG. 1 which further includes a sound absorbing material 210. Referring to FIG. 2, the sound absorbing material 210 may be applied to either a front of the reflection plate 130, that is, a side facing the baffle 120, or a back of the baffle 120, that is, a side facing the reflection plate 130, in order to absorb high-frequency components of the sound output from the sound transducer 110. Where a rigid body is used as the reflection plate 130 or a hard plane of the baffle 120 is used intact in a high frequency range, complex interference may occur in the high frequency range. The form of complex interference in the high frequency range will be described with reference to FIG. 8. As an illustration, for example, it is understood that any rigid or stiff material that can block or reflect sound may be used to implement the reflection plate 130 or the baffle 120. In another exemplary implementation, a structure having stiffness to block or reflect sound at a low frequency range while having a sound absorbing characteristic at a high frequency range may be used as the reflection plate 130 or the baffle 120.

In the high frequency range, sufficient directivity may be obtained without the element such as the reflection plate 130. Thus, where the reflection plate 130 is used, the sound absorbing material 210 may be attached to the reflection plate 130 in order to absorb the high-frequency components. Accordingly, interference at the reflection plate 130 or the baffle 120 may be reduced.

Figure 3A:
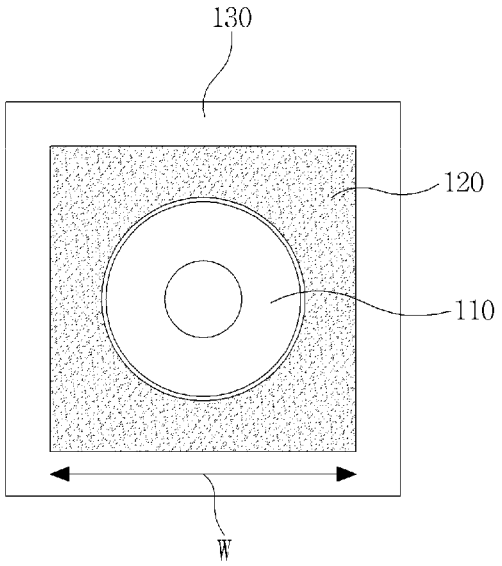
FIGS. 3A and 3B are diagrams illustrating a front view and a perspective view of an exemplary directional sound generating apparatus.
Figure 3B:
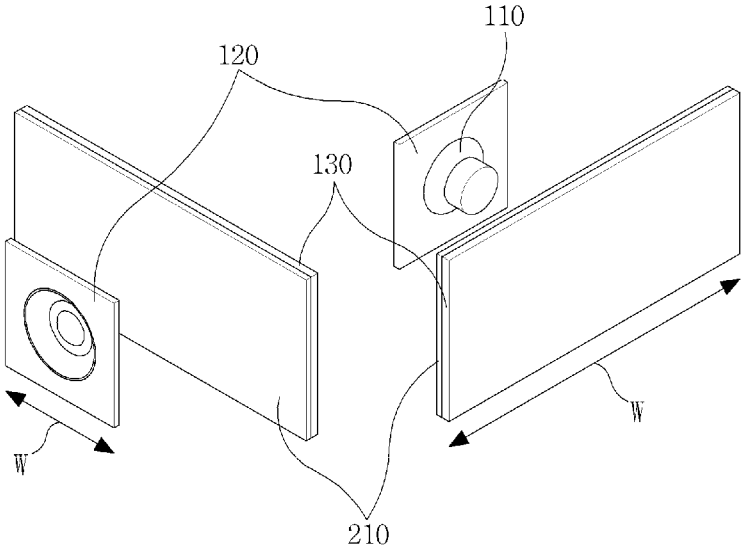

FIGS. 3A and 3B show a front view and a perspective view of an exemplary directional sound generating apparatus.

Referring to FIGS. 1, and 3A and 3B, the baffle 120 is formed, for example, as a plate, smaller than the reflection plate 130. Also, the baffle 120 is disposed substantially perpendicular to a traveling direction of sound waves from the sound transducer 110. For example, the baffle 120 is disposed substantially flush with the sound transducer 110 to separate the front and the back of the sound transducer 110. The size of the baffle 120 may vary according to the size of an enclosure of the directional sound generating apparatus and frequency properties. For example, if the size of the baffle 120 is similar to or greater than the sound wavelength, a complex interference pattern may be generated. Accordingly, while not necessary, the width W of the baffle 120 may be designed to be smaller than a wavelength at the highest frequency in the low frequency range. Taking the descriptions above into account, the width W of the baffle 120, which may be shorter than the wavelength of the highest frequency in the low frequency range, can be designed to be smaller than the width W of the reflection plate 130 as shown in FIG. 3B.

Figure 4:
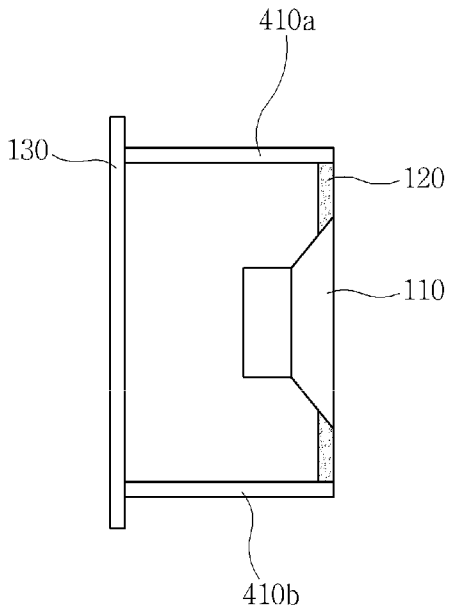
FIG. 4 is a diagram illustrating a side view of another exemplary directional sound generating apparatus.

FIG. 4 shows another exemplary directional sound generating apparatus. Referring to FIG. 4, a roof 410 is further provided as a second blocking plate in the directional sound generating apparatus of FIG. 1. To maximize the reflection characteristic of the reflection plate 130, the reflection plate 130 is ideally infinitely large, or at least much larger than the wavelength. However, since it is impossible to implement an infinitely large reflection plate, the reflection plate 130 should have a specific size and directivity so as to achieve a desired performance regardless of where the directional sound generating apparatus is located.

Personal sound zone in relation to directivity is generally formed according to horizontal sound pressure changes. In other words, vertical distance changes, for example, the height of a listener as determined by position, posture, and the like, generally do not cause changes in sound pressure, but distance changes to the right or left cause changes in sound pressure to form a desired personal sound zone.

To this end, the roofs 410 may be provided such that, from a side view of FIG. 4, top and bottom areas are covered to avoid destructive interference in the vertical direction while right and left sides are open. That is, as shown in FIG. 4, the roofs 410 are each connected with the reflection plate 130 and the baffle 120, and cover the top and bottom of the sound transducer 110, so as to lower the vertical directivity of the sound waves output from the sound transducer 110. By doing so, the size of the back reflection plate 130 and/or the volume of the sound transducer 120 may be reduced. Also, radiated sound pressure may be increased by preventing destructive interference in the vertical direction. In another implementation, the roof 410 may be connected to the reflection plate 130 and the sound transducer 110.

It is understood that, the roof(s) 410 may be designed to block the reflection plate 130 completely or partly from the sound transducer 110. While the roofs 410 are provided to cover the top and bottom of the sound transducer 110 in FIG. 4, that is, a roof 410*a* is provided to cover the top of the sound transducer 110 and a roof 410*b* is provided to cover the bottom of the sound transducer 110, other implementations may be provided where a roof 410 covers only the top or bottom of the sound transducer 110. Various exemplary forms of the roof 410 will also be described with reference to FIGS. 7A to 7C.

Figure 5:
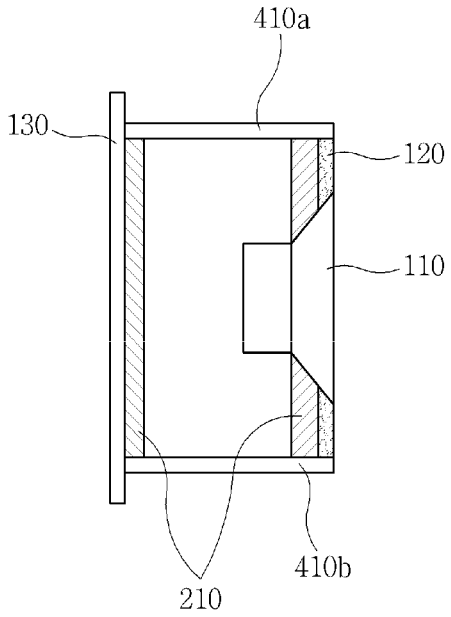
FIG. 5 is a diagram illustrating a side view of still another exemplary directional sound generating apparatus having a baffle, a roof, and a sound absorbing material.

FIG. 5 shows still another exemplary directional sound generating apparatus having a baffle 120, a roof 410, and a sound absorbing material 210.

Referring to FIG. 5, the sound absorbing material 210 absorbs high-frequency components as described with reference to FIG. 2, and accordingly, the complex interference may be prevented in the high frequency range.

Figure 6:
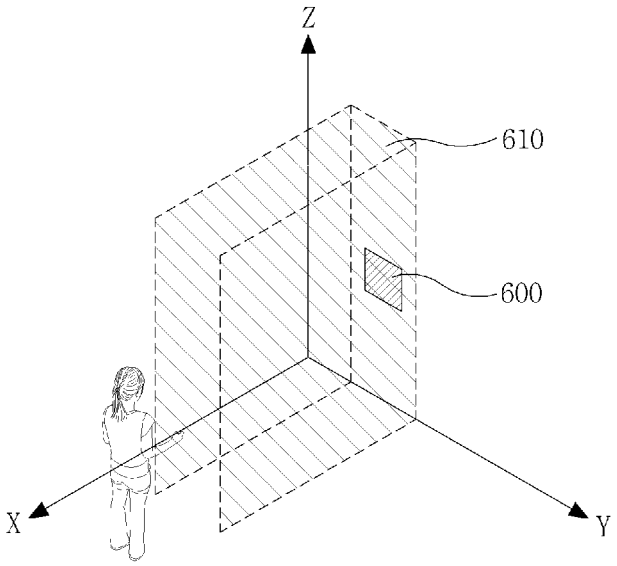
FIG. 6 is a diagram illustrating a sound zone of an exemplary directional sound generating apparatus.

FIG. 6 shows a personal sound zone 610 of an exemplary directional sound generating apparatus 600.

The personal sound zone 610 of a particular form shown in FIG. 6, with reference to FIG. 4, may be generated by increasing horizontal directivity and reducing vertical directivity by use of the directional sound generating apparatus 600 having the baffle 120, the reflection plate 130 and the roof 410. Hence, a predetermined area of a sound zone may be generated regardless of the installation height of the directional sound generating apparatus 600 and the listener's height or posture.

Figure 7A:
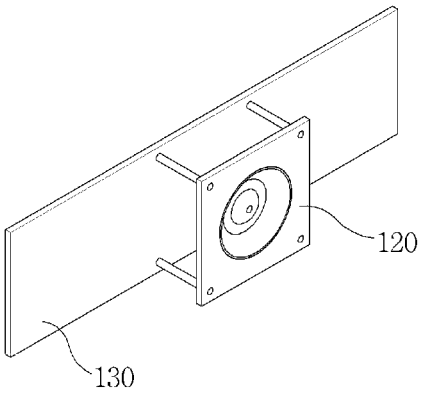
FIGS. 7A to 7C are diagrams illustrating various forms of an enclosure of a directional sound generating apparatus.
Figure 7B:
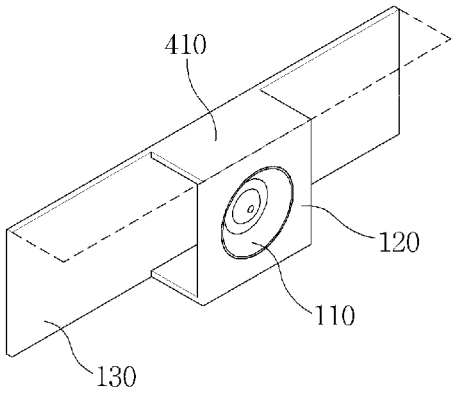
Figure 7C:
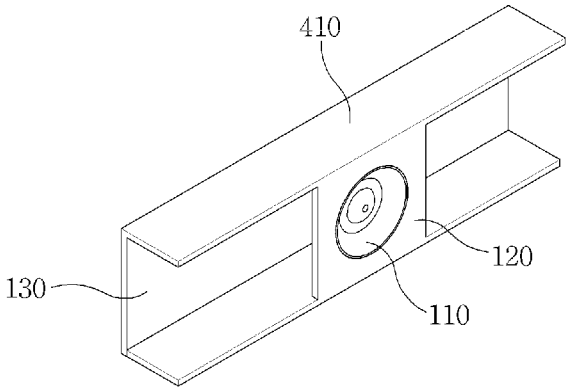

FIGS. 7A to 7C illustrate various forms of an enclosure of a directional sound generating apparatus.

Referring to FIGS. 7A to 7C, a baffle 120 or a roof 410 may vary in shape. FIG. 7A shows an enclosure of a directional sound generating apparatus having only the baffle 120 without the roof 410, and FIGS. 7B and 7C show enclosures of a directional sound generating apparatus having the roof 410 and the baffle 120.

The roof 410 may be designed to partly cover a space plane (see a dotted line in FIG. 7B defining the plane) between the reflection plate 130 and the sound transducer 110 as shown in FIG. 7B, or to completely cover the space plane between the reflection plate 130 and the sound transducer as shown in FIG. 7C.

Figure 8:
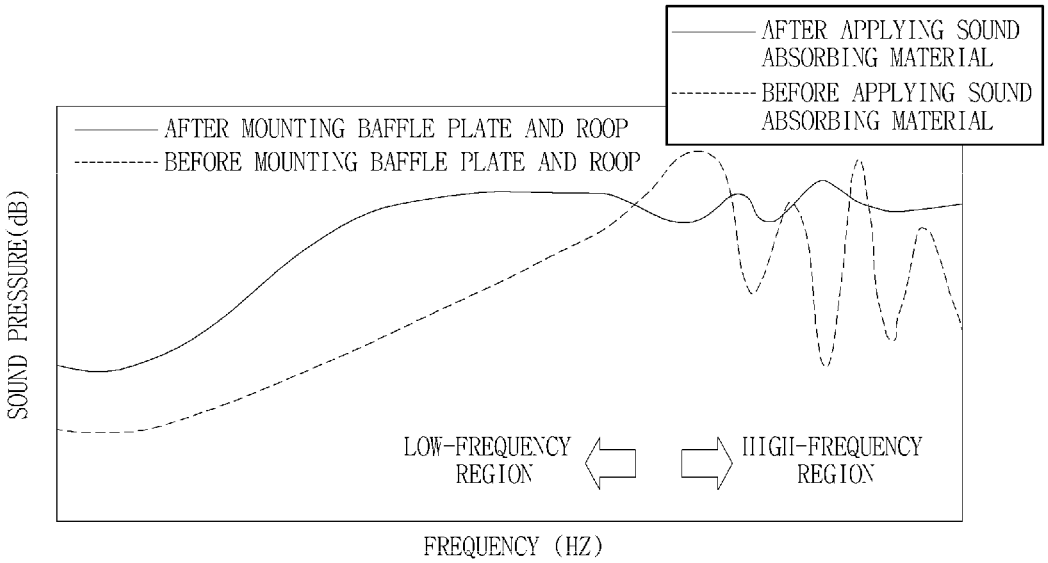
FIG. 8 is a graph showing a frequency response characteristic in a low frequency range in response to a baffle and a roof being used, and a frequency response characteristic in a high frequency range in response to a sound absorbing material being used.

FIG. 8 is a graph showing a frequency response characteristic in a low frequency range in response to a baffle and a roof being used, and a frequency response characteristic in a high frequency range in response to a sound absorbing material being used.

Referring to FIG. 8, high-frequency components are absorbed by the sound absorbing material so that the complex interference in the high frequency range may be avoided. As described above, in the high frequency range, it may be possible to obtain a desired directivity without additional elements like the baffle or the reflection plate. Accordingly, where the elements like the baffle or the reflection plate are used, it may be appropriate to use the sound absorbing material to reduce interference at the baffle or the reflection plate in the high frequency range.

For example, the baffle and the roof elements may be used to increase sound pressure in the low frequency range, but they may cause sound pressure perturbation in the high frequency range. Since the sound pressure increase in the high frequency range is not needed, that is, since perturbation or interference should be avoided, sound interference due to the baffle or the roof may be suppressed by applying the sound absorbing material for the high frequency range. As an example, a sound absorbing material such as acoustic foam, for example, a polyurethane or glass wool may be used. Such a material may have low impact in a low frequency region, for example, because the size of perforated holes in the material is smaller than the wavelength of the low frequency sound, while having high sound absorbing characteristic in a high frequency region, for example, above 1 kHz. It is understood that the approximate cut-off frequency may vary depend on the material.

Figure 9:
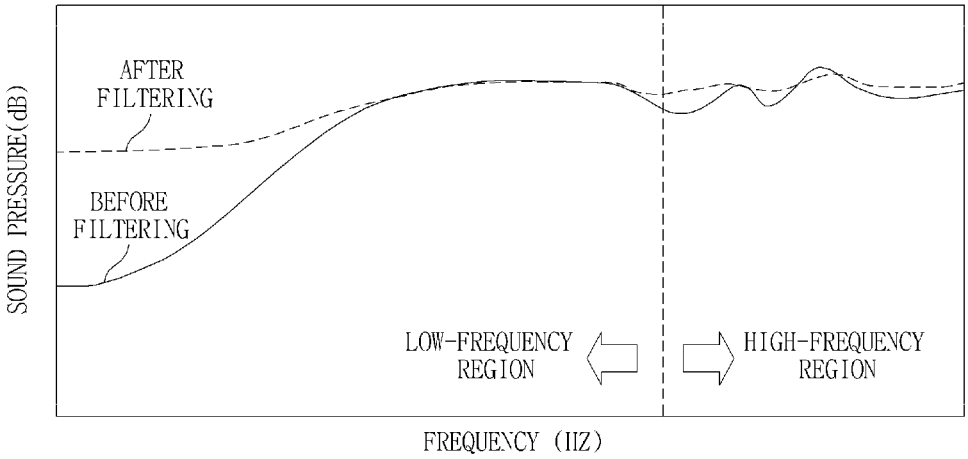
FIG. 9 is a graph showing a frequency response characteristic of an exemplary directional sound generating apparatus having a preprocessing unit.

FIG. 9 is a graph showing a frequency response characteristic of an exemplary directional sound generating apparatus having a preprocessing unit. The directional sound generating apparatus may be one among the directional sound generating apparatuses described with reference to FIGS. 1-7C.

The frequency response characteristics of the directional sound generating apparatus may vary according to a frequency range. For example, in the low frequency range, the directional sound generating apparatus may have uniform frequency response characteristics, and sound pressure may decrease in inverse-proportion to frequency. In the high frequency range, the directional sound generating apparatus may have irregular frequency response characteristics although the sound pressure is high.

Accordingly, a preprocessing unit may be further included to separate low-frequency components and high-frequency components of sound to be output from the sound transducer, and adjust linearly or compensate the separated frequency components with reference to the frequency response characteristics of the sound transducer.

The preprocessing unit may adjust the response characteristics linearly in the low frequency range, and adjust the irregular response characteristics in the high frequency range. As one example, a low-pass filter (LPF) or a high-pass filter (HPF) may be used to separate the high- and low-frequency components, and an amplifying filter or an inverse filter may be used to separate and process sound signals based on a frequency range.

Referring to FIG. 9, it is noted that response characteristics are improved by separating a sound signal in the low frequency range by use of the low-pass filter and adjusting the linear change. In the low frequency range, the sound signal is adjusted not by amplifying frequencies simply to the same level, but by amplifying each frequency with a different amplification level. Then, the high-pass filter is used to separate the high-frequency components, and an inverse filter which has a characteristic opposite to the uneven response characteristic is used so that the response characteristics of the high-frequency components can be improved. A filter may be selected with reference to response characteristics which may be measured in advance in the low frequency range and the high frequency range.

Figure 10:
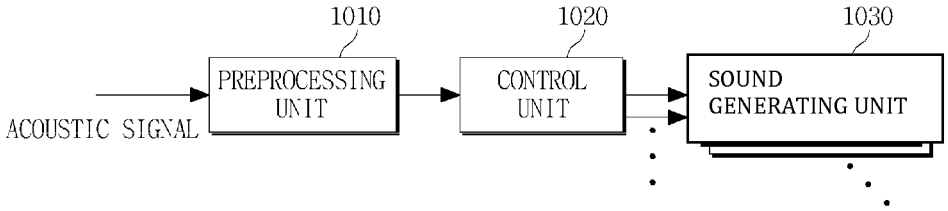
FIG. 10 is a block diagram of an exemplary directional speaker array.

FIG. 10 shows an exemplary directional speaker array.

The directional speaker array may be implemented by a plurality of directional sound generating apparatuses as described above. In general, the more directional sound generating apparatuses are used, the greater directivity and radiation efficiency become.

Referring to FIG. 10, the directional speaker array includes a preprocessing unit 1010, a control unit 1020, and sound generating units 1030. Each sound generating unit 1030 may correspond to one of the directional sound generating apparatuses described above with reference to FIGS. 1 to 9. The preprocessing unit 1010 adjusts response characteristics at each frequency in the low frequency range, and compensates for the irregular response characteristics in the high frequency range. To this end, sound signals may be separated based on a frequency range by a low-pass filter or an inverse filter. The control unit 1020 provides the sound generating units 1030 with the sound signals processed by the preprocessing unit 1010. That is, the control unit 1020 processes the sound signals which have been separated according to the frequency range and adjusted or compensated, and provides the processed sound signals to the sound generating units 1030.

Figure 11:
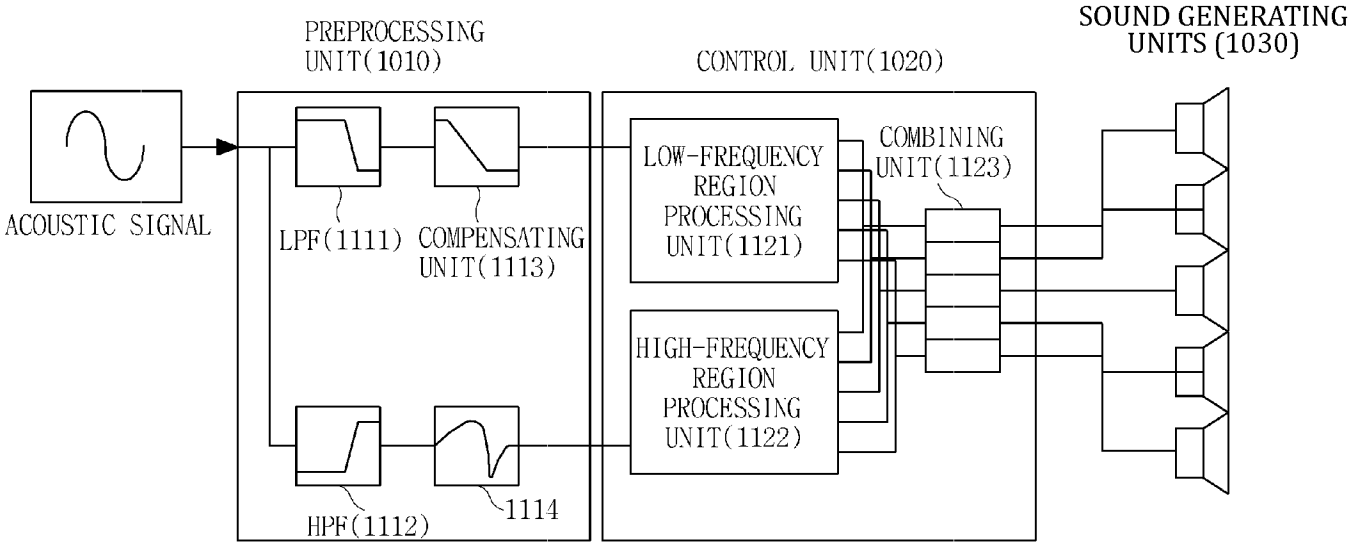
FIG. 11 is a block diagram further illustrating the directional speaker array of FIG. 10.

FIG. 11 further illustrates the directional speaker array of FIG. 10 according to one implementation.

The preprocessing unit 1010 includes a low-pass filter 1111, a high-pass filter 1112, a compensating unit 1113, and an inverse filter 1114. The preprocessing unit 1010 receives the sound signal, the low-pass filter 1111 separates the low-frequency components of the sound signal, and the compensating unit 1113 amplifies the sound signal in each frequency range. The inverse filter 1114 has opposite response characteristics to high-frequency response characteristics of the directional sound generating units 1030. By using the inverse filter 1114, the high-frequency response characteristics may be compensated evenly.

The control unit 1020 includes a low frequency range processing unit 1121, a high frequency range processing unit 1122, and a combining unit 1123. The low frequency range processing unit 1121 and the high frequency range processing unit 1122 generate and output sound signals to be provided to a number of sound generating units 1030, and the combining unit 1123 combines the sound signals separated according to the frequency range into one composite sound signal and sends the composite sound signal to each sound generating unit 1030.

Figure 12:
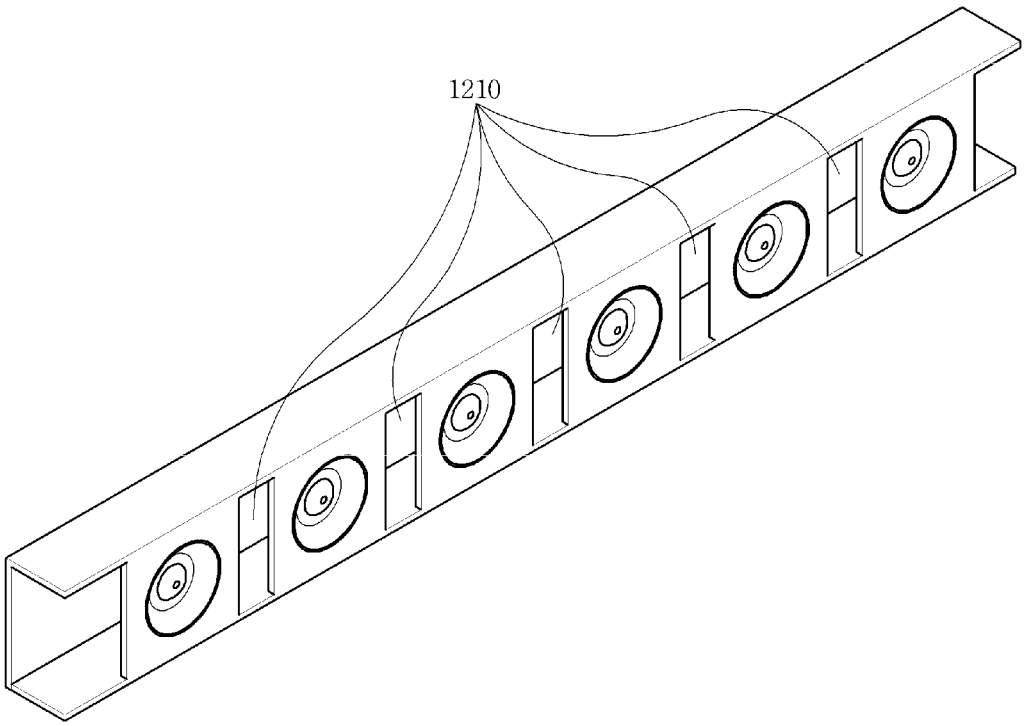
FIG. 12 is a diagram illustrating a perspective view of an exemplary directional speaker array.

FIG. 12 shows an exemplary directional speaker array.

Respective reflection plates employed on a plurality of directional sound generating units may be shared by the directional sound generating units, or may be implemented in one dimension or piece as shown in FIG. 12, or in two dimensions or pieces, and so on. Also, distances between the directional sound generating units may vary as needed. Baffles may be formed of a single plate with slits or openings 1210 therebetween. The width of the slits may vary according to the distances between the directional sound generating units.

Throughout the specification, a low frequency range and a high frequency range has been discussed. It is understood that a frequency range may depend on factors including a propagating distance between a front and rear diaphragm of a loudspeaker and a distance between a reflecting surface and the loudspeaker. Accordingly, the low and high frequency range can be identified according to the individual design of the sound generating apparatus. For example, referring back to FIG. 1, the baffle 120 is provided to increase the distance d2, and accordingly, the frequency range and a cut-off frequency may depend on the shape and size of the baffle 120, which can be identified through an undue experiment.

According to examples described above, sound directivity may be improved while uniform sound pressure maintained throughout the whole frequency range. For example, in a low frequency range for which a long speaker array may be desired, high directivity may be achieved without extending the array size. Accordingly, noise pollution or disturbance may be minimized for people not located in a personal sound zone.

According to examples provided above, a directional sound generating apparatus may be provided in a simple structure, and the effective distance between a front and back of a sound transducer may be increased. Accordingly, high radiation efficiency may be obtained. Also, a vertical directivity may be removed while maintaining a horizontal directivity, and thus a constant directivity characteristic may be obtained regardless of a listener's height or posture, or an installation position of the directional sound generating apparatus.

Additionally, where a sound absorbing material is further provided in the directional sound generating apparatus, it may improve the irregular directivity and frequency response that may be generated in a high frequency range. Accordingly, it may be possible to implement a directional sound generating apparatus applicable across the whole frequency range with only one array. Furthermore, by separating the low frequency range and the high frequency range and performing preprocessing in each frequency range, sound distortion may be reduced.

The methods described above may be recorded, stored, or fixed in one or more computer-readable media that includes program instructions to be implemented by a computer to cause a processor to execute or perform the program instructions. The media may also include, alone or in combination with the program instructions, data files, data structures, and the like. Examples of computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules in order to perform the operations and methods described above, or vice versa.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A directional speaker array comprising:

one or more sound transducers each configured to output sound of opposite phase from a front and a back thereof, respectively;

a reflection plate which is located behind the sound transducers and which is configured to control the horizontal directivity of sound;

a first blocking plate which is provided between a front portion and a back portion of the sound transducers and which is configured to increase an interference distance between forward and backward sound waves output from the one or more sound transducers; and one or more second blocking plates provided between the reflection plate and the first blocking plate so as to cover one or more respective sides of a space defined between the reflection plate and the first blocking plate, wherein the first blocking plate includes one or more openings provided between the sound transducers.

2. The directional speaker array of claim 1, further comprising a sound absorbing material provided to the reflection plate and/or the first blocking plate.

3. The directional speaker array of claim 2, wherein the sound absorbing material absorbs high-frequency components of the forward and backward sound waves and/or the backward sound wave output from the sound transducer.

4. The directional speaker array of claim 1, wherein the first blocking plate extends substantially perpendicular to a traveling direction of sound waves output from the sound transducers and has a narrower width than the reflection plate.

5. The directional speaker array of claim 1, wherein a width of the one or more second blocking plates is equal to or less than a width of the reflection plate such that the one or more second blocking plates completely or partly covers a space substantially perpendicular to the reflection plate and provided between the reflection plate and the sound transducers.

6. The directional speaker array of claim 1, wherein the first blocking plate has a narrower width than the reflection plate.

7. The directional speaker array of claim 1, wherein the reflection plate, the first blocking plate, and the one or more second blocking plates are formed as a single structure.

8. The directional speaker array of claim 1, wherein a length of a side of the one or more second blocking plates is equal to or less than a length of a side of the reflection plate that is substantially parallel to the side of the one or more second blocking plates.

9. The directional speaker array of claim 1, wherein:

the reflection plate, the first blocking plate, and the one or more second blocking plates are formed as a single structure.

10. The directional speaker array of claim 1, wherein a sound pressure of sound radiated from the sound transducers varies according to a wavelength of the sound, a distance between the sound transducers and the reflection plate, and the interference distance between the forward and backward sound waves output from the sound transducers.

11. A directional speaker array comprising:

a plurality of directional sound generating units, at least one of which comprising:

a sound transducer configured to output sound of opposite phase from a front and a back thereof, respectively, a reflection plate which is located behind, and disposed parallel to, the sound transducer to reflect sound radiated backward from the sound transducer, and a first blocking plate which is provided between a front portion and a back portion of the sound transducer and which is configured to increase an interference distance between forward and backward sound waves output from the sound transducer, wherein:

the at least one of the plurality of directional sound generating units further comprises one or more second blocking plates provided between the reflection plate and the first blocking plate so as to cover one or more respective sides of a space defined between the reflection plate and the first blocking plate each of the plurality of directional sound generating units comprises the sound transducer, the reflection plate, the first blocking plate, and the one or more second blocking plates, the reflection plates are formed as a single reflection plate shared by the plurality of directional sound generating units, and the first blocking plates are formed as a single first blocking plate shared by the plurality of directional sound generating units.

12. The directional speaker array of claim 11, wherein the at least one of the plurality of directional sound generating units further comprises a sound absorbing material provided to the reflection plate and/or the first blocking plate.

13. The directional speaker array of claim 12, wherein the sound absorbing material absorbs high-frequency components of the forward and backward sound waves and/or the backward sound wave output from the corresponding sound transducer.

14. The directional speaker array of claim 11, wherein the first blocking plate extends substantially perpendicular to a traveling direction of the forward and backward sound waves output from the sound transducer and has a narrower width than the reflection plate.

15. The directional speaker array of claim 11, wherein a length of a side of the one or more second blocking plates is equal to or less than a length of a side of the reflection plate that is substantially parallel to the side of the one or more second blocking plates.

* * * * *